US006261028B1

(12) United States Patent
Volpe et al.

(10) Patent No.: US 6,261,028 B1
(45) Date of Patent: Jul. 17, 2001

(54) PORTABLE, MODULAR, UNDERWATER BURIAL/MARINE HABITAT

(76) Inventors: Thomas J. Volpe, 20176 Susan Ave., Port Charlotte, FL (US) 33952; Thomas N. Volpe, 75 Fox Run North, Flinstone, GA (US) 30725

( * ) Notice: Subject to any disclaimer, the term of this patent is extended or adjusted under 35 U.S.C. 154(b) by 0 days.

(21) Appl. No.: 09/418,304

(22) Filed: Oct. 14, 1999

(51) Int. Cl.[7] ..... E04H 13/00

(52) U.S. Cl. ..... 405/210; 27/1; 27/2; 52/131; 52/133; 52/136

(58) Field of Search ..... 405/195.1, 210; 27/1, 2; 52/128, 131, 133, 136

(56) References Cited

U.S. PATENT DOCUMENTS 3,732,602 * 5/1973 Vigh ..... 27/1
3,878,656 * 4/1975 Duwe et al. ..... 52/136 X
4,041,582 * 8/1977 MacDonald ..... 27/2
5,127,112 * 7/1992 Brock ..... 27/1
5,590,446 * 1/1997 Hicks ..... 27/1
5,774,958 * 7/1998 Casimir ..... 27/1
5,881,505 * 3/1999 Larkin, III et al. ..... 52/136
5,894,699 * 4/1999 Fulton et al. ..... 52/131 X
6,041,483 * 3/2000 Burch ..... 27/1
6,105,315 * 8/2000 Stoecklein et al. ..... 52/131 X
6,161,268 * 12/2000 Joseph ..... 27/1 X
6,189,188 * 2/2001 O'Hare ..... 27/1

* cited by examiner

*Primary Examiner*—David Bagnell
*Assistant Examiner*—Tara L. Mayo
(74) *Attorney, Agent, or Firm*—Frank A. Lukasik

(57) ABSTRACT

A portable, modular, underwater burial/marine habitat anchored on an underwater surface consisting of a plurality of base sections and top sections each having extruded, lightweight concrete slabs and having a plurality of removable walls and egress openings, the sections being joined together and stacked in a desired configuration to form an underwater burial site and a marine sanctuary.

3 Claims, 5 Drawing Sheets

PORTABLE, MODULAR, UNDERWATER BURIAL/MARINE HABITAT

BACKGROUND OF THE INVENTION

1. Field of the Invention

This invention relates generally to dual purpose underwater structures and more particularly to an underwater burial site which will induce marine life to reside around and within the complex underwater structure 2. Discussion of the Prior Art There are numerous systems and structures available above ground which serve as burial sites. There are also numerous systems submerged to serve a sanctuaries for the development of marine life. Burial at sea has long been known as the common method of disposing of the remains of deceased sailors and other maritime passengers. In addition, yacht clubs commonly provide burial at sea services. One such method and apparatus for underwater burials is U.S. Pat. No. 5,127,112 to Brock which discloses an enclosed air, and water-tight capsule filled with a preservative gas or liquid. The burial chamber provides a method of keeping a corpse in a freshly preserved state at the bottoms of bodies of water.

U.S. Pat. No. 5,564,369 to Barber et al which discloses a method and apparatus for producing artificial reef modules which can be deposited on the ocean floor for permitting growth of coral and other marine growth thereon. The reef balls can be left permanently at a particular location to develop an artificial reef or can be harvested for use in aquariums.

U.S. Pat. no. 3,732,602 discloses a submersible crematory urn which supports ecological conservation efforts. The patent to Vigh does not disclose an urn having numerous openings and crevices and including an artistic mosaic design. None of the above references disclose a plurality of units in a hierarchy to form a graded underwater structure.

SUMMARY OF THE INVENTION

The present invention pertains to a method and apparatus for constructing a habitat designed and built to transport and contain urns with cremated remains as well as a sanctuary for the development of marine life. The top and bottom sections are prefabricated and floated to the selected assembly area. Locking devices secure the urns. Each cavity will be covered with a flat PVC billet used as a monument with engravings to identify the contents. Slots for marine access are formed below the doors for water flow. The interior walls will be removable and interlocking to allow for marine life and family size of the remains of inhabitants.

DESCRIPTION OF THE PREFERRED EMBODIMENT

Figure 1:
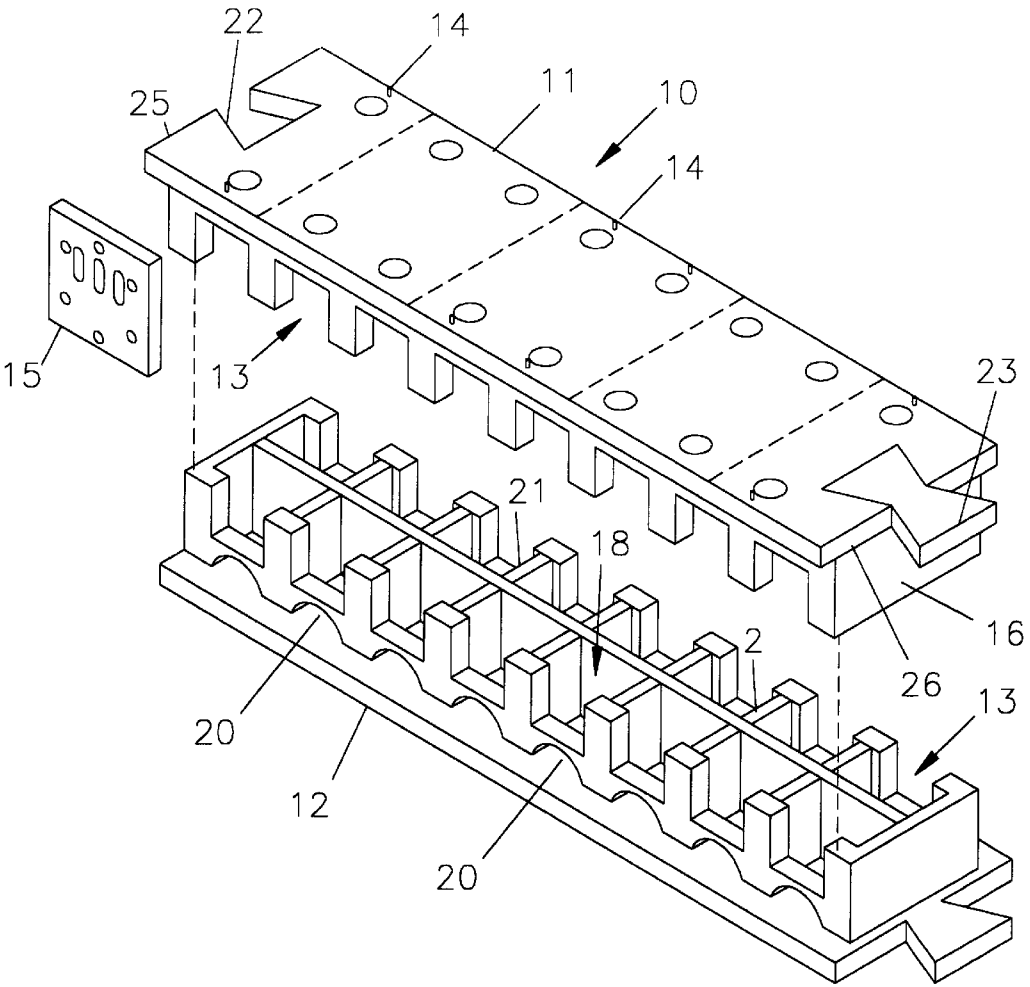
FIG. 1 is an exploded perspective view of a habitat in accordance with the invention.
Figure 3:
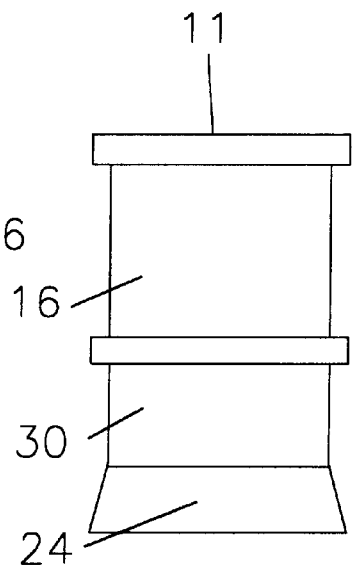
FIG. 3 is an end view of the habitat in accordance with the invention.
Figure 4:
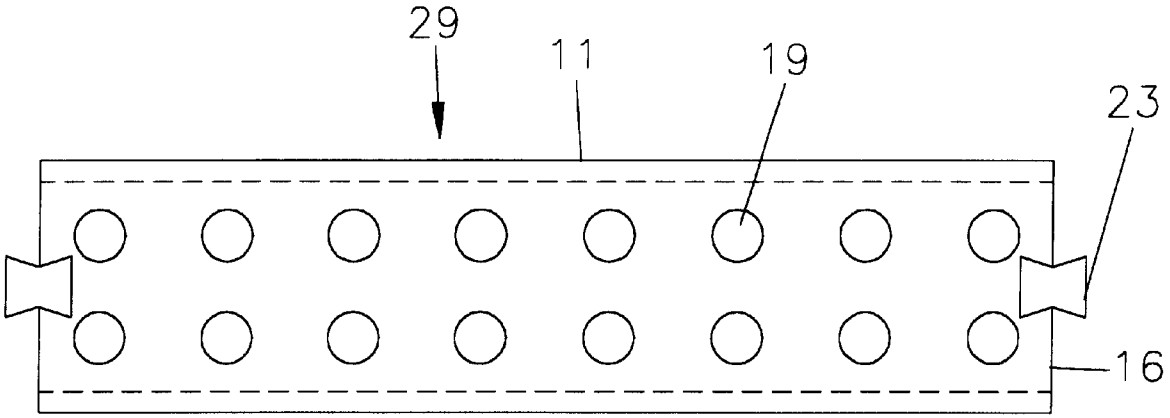
FIG. 4 is a top view of the habitat in accordance with the invention.
Figure 2:
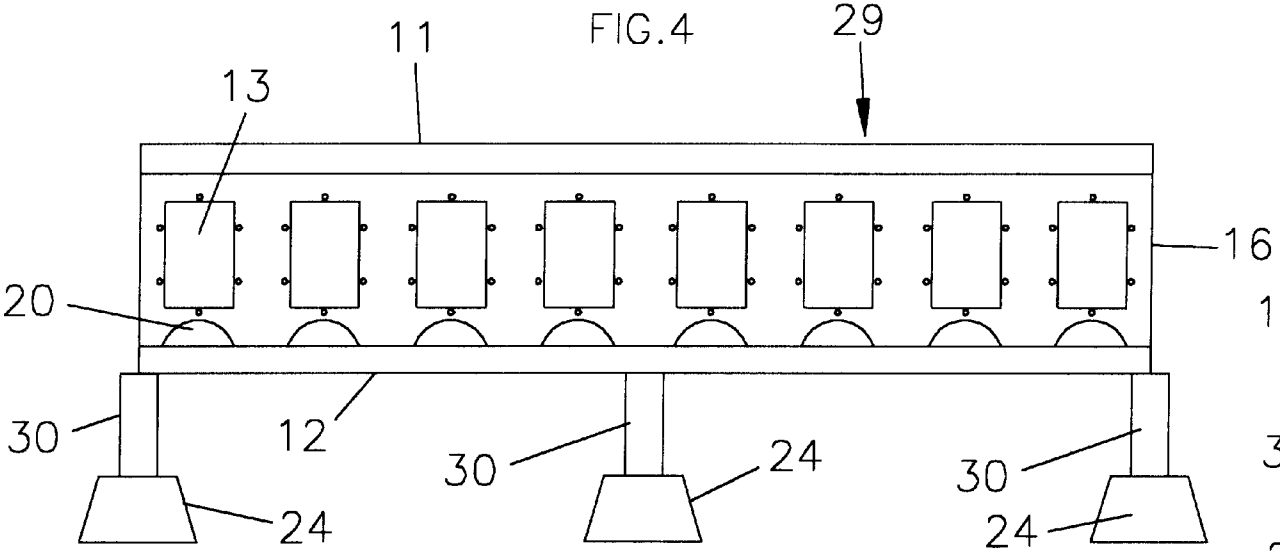
FIG. 2 is a front view of the habitat in accordance with the invention.

Referring now to the drawings wherein like numerals signify like parts there is shown in FIG. 1 an exploded, perspective view of the habitat 10 in accordance with the invention. The habitat 10 consists of a top section 11, and a bottom section 12. The top section 11 and bottom section 12 may be designed to be a standard size 4'×16" extruded 6" lightweight concrete slabs with eight egress openings 13 and pre-positioned plugs 14 for assembly as well as for securing cover plates 15.

The top section 11, bottom section 12, and the sides 16 are welded together by ⅜ steel plates (not shown) preset into the concrete during the pour. Posts formed into the backside of the monument cover plates 15 are used to set the urns into permanent position at port or when submerged. Locking devices 17 will enable the urns to be secure yet could be relocated as the need may arise. Each cavity 18 will be covered with a flat PVC billet used as a monument (cover plates 15). Plates 15 will be placed over each cavity 18 to identify modules and sections in modules. Holes 19 can be formed whenever they will not decrease the structural integrity of the module. Slots 20 for marine access will also be below the doors (egress openings 13) for water flow.

All structural material is designed to encourage, sustain and help propagate marine life. The concrete is neutralized with no higher than an 8.5 PH factor while surfaces are textured to attract embryonic marine life and to promote the ecological life cycle. The interior walls 21 will be removable and interlocking to allow for size variations of marine life and family size of the remains of the interred.

Figure 9:
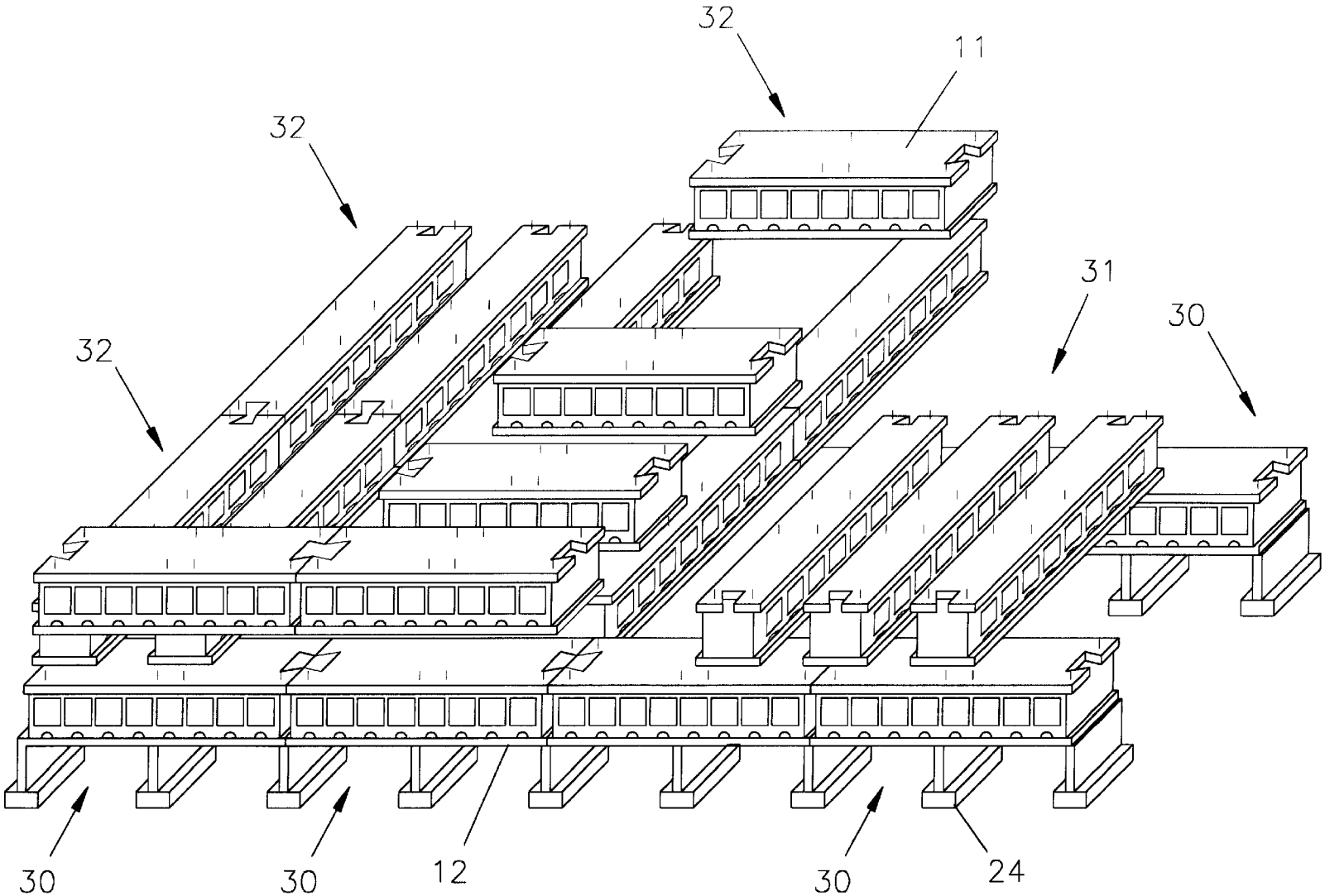
FIG. 9 is a top perspective view of a plurality of sections adjoined by interlocking ends in accordance with the invention.
Figure 10:
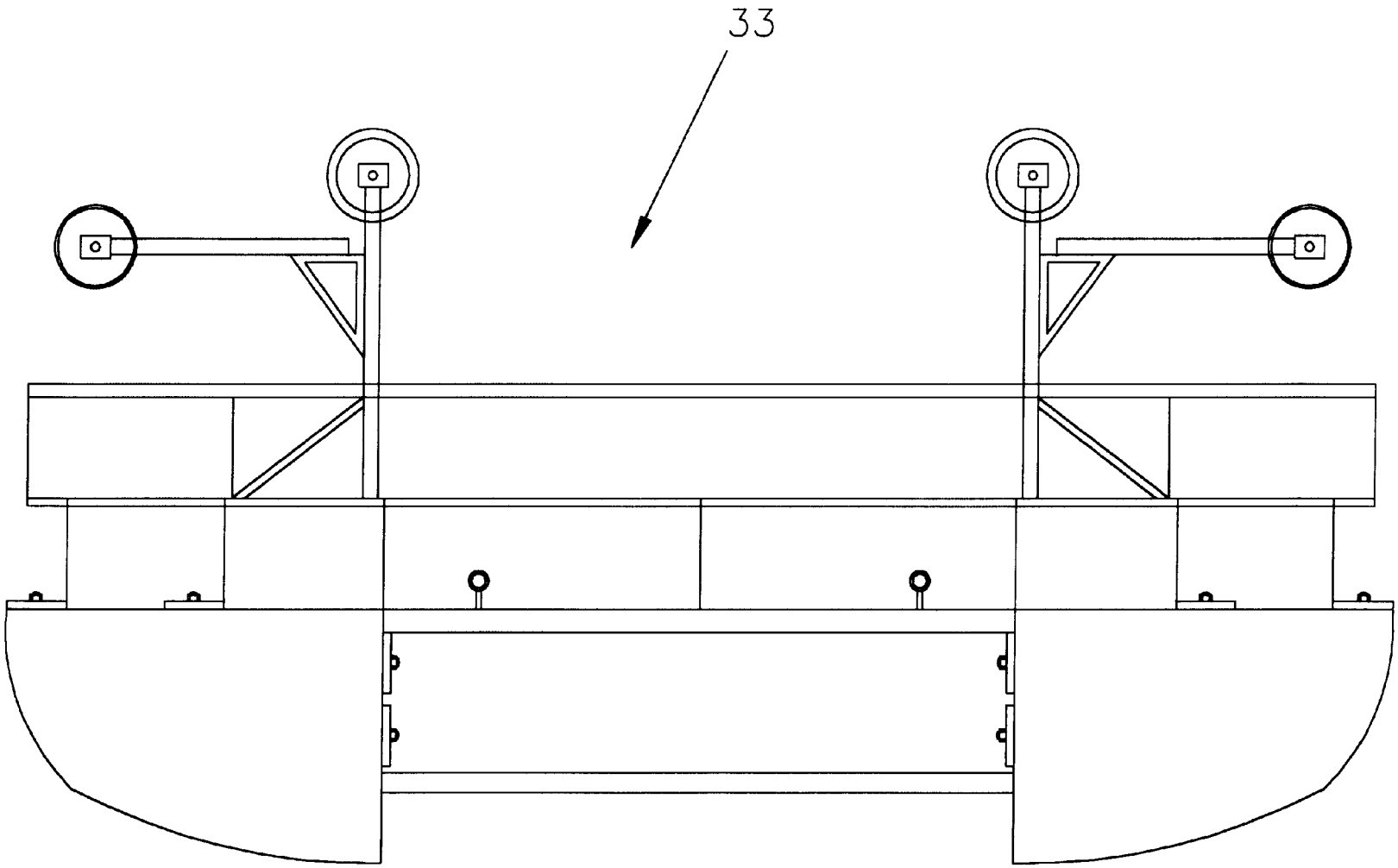
FIG. 10 is a side view of a pontoon boat for transporting the habitat in accordance with the invention.

Each of the top sections 11 have interlock notches 22 formed at each of the ends 25 and 26. The habitat 10 has modular interchangeable parts (top section 11 and bottom section 12) so that the ultimate shape can be modified to suit the terrain (FIG. 9), depth, and type of habitat.

Figure 8:
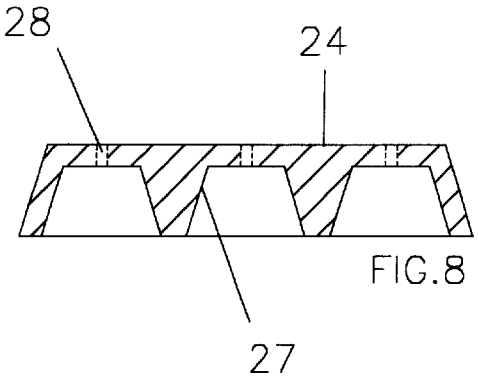
FIG. 8 is a front sectional view of the base section in accordance with the invention.
Figure 6:
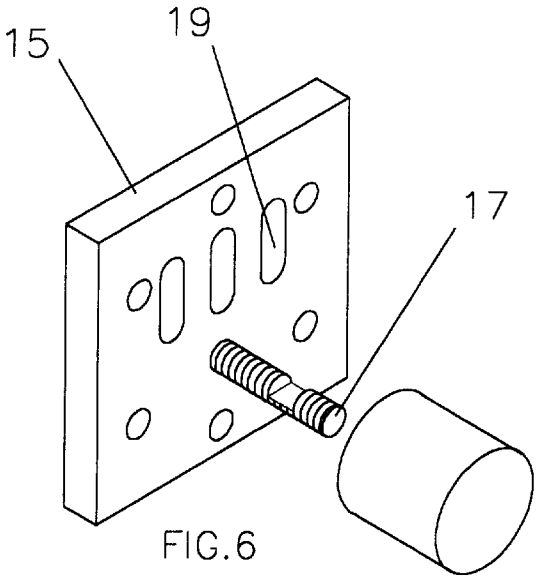
FIG. 6 is a perspective view of a monument with engravings in accordance with the invention.
Figure 7:
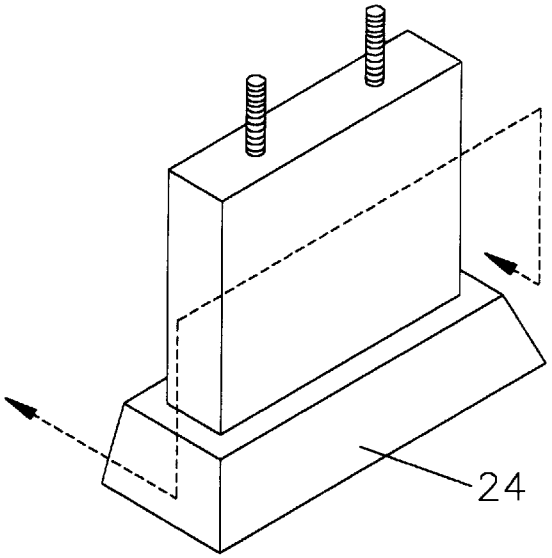
FIG. 7 is a top perspective view of a base section in accordance with the invention.

FIGS. 7 and 8 show masonry footers 24 which will be placed on the lower level to compensate for sandy bottoms. Chambers 27 are formed at the bottom of footers 24 and tubes 28 are formed to permit withdrawal of sand from under specific partitions to balance each module 29 as well as to sink the footers 24. The footers 24 will serve as an anchor during storm conditions as prescribed by the Army Corp of Engineers and local building codes.

Figure 5:
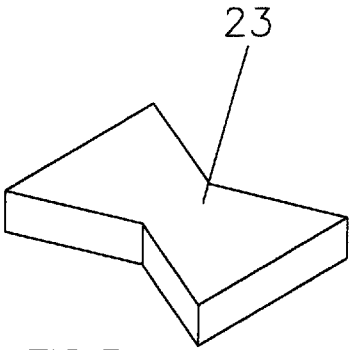
FIG. 5 is a perspective view of a locking device in accordance with the invention.

A minimum of four base sections 30 and three second tier sections 31 should be assembled before urns can be permanently installed. Additional modules 32 as shown in FIG. 5, can be stacked within twenty feet of mean low tide. It would be preferable to not have divers go deeper than fifty feet, which would mean that modulars could be built as high as five tiers at one location. The length along the bottom surface is subject to geological data and current velocity during a 110 MPH storm. As shown in FIG. 5, various art forms can be created by selective placement of modules and specific species of larger fish could inhabit space outside of the modules.

A thirty foot pontoon boat 33, designed especially for the invention, will transport the assembled structures out to sea after being lowered below the water's surface. A V-shaped fiberglass hull and bow with an inflatable interior (not shown) is temporarily attached to the ends of the structure and pontoons, when lowered below the water line, so that the boat can be load line certified while transporting pre-assembled modules and allowing more buoyancy during placement. NASA will assist by using the Docking Guidance System, used in space, to guide a robot using sensors and computers to guide the modules into place.

Combining the design of an underwater structure as a stationary memorialization for burial at sea and to enhance the landscape with a functional attraction to sea life is a design feature of the invention. Thus when a family paid their respects, or needed to establish closure, they could be set at ease by a "Sea of Tranquillity" should they desire to dive at the site or visit by boat. A community would be encouraged to support this concept because such activity would bring people to their area and bring revenue to related businesses.

It has been found that the National cremation rate is currently approximately 19.95% and is estimated to be rising at the rate of 1.33% per year and estimated to peak at 35%. The option to have permanent location at sea where a loved one could become a fixture in a geological environment will serve as piece of mind to the family. Such a concept will add to other existing options of being scattered at sea. The key to acceptance of the habitat of the invention is to design units light enough to transport as part of the burial cremains and easy enough to place, yet stable enough to endure 110 MPH storms (category 3 hurricanes).

Seven modules will be built and an experienced reef contractor will be used to place the pilot model. A cremation society will be formed and a web page will be on line. It is intended to provide market analysis data, and franchise sites will be established using established funeral homes. The reef will be continuously improved and information will be maintained for animal husbandry. NASA contacts will be continued for space age placement techniques and local agencies will be contacted for ideal sea reef locations.

The ornamental design of the invention permits commercially generated financial resources to generate far more expansive projects compared to volunteer or regional reef projects. While the preferred embodiment of the invention is to design a mausoleum to inter urns, the invention also relates to certain improvements in creating the environment for marine inhabitants of an artificial reef. The design of the invention comprises either low and/or high profile reef units which will induce marine life to reside around the complex structured enclosure as well as within individual modular units which have numerous openings and crevices subject to the dimensions of the desired inhabitants and the elevation of the tier. The supplying means comprises the placement of modules creating an underwater burial site, consisting of a permanent enclosure with an artistic mosaic structure with reef configurations consisting of a hierarchal arrangement of many units to form a set and several sets to form groups of clusters.

The habitat of the invention transforms an environmental problem, burial sites, into a solution which supports ecological conservation efforts and enhances economic activity while attending to the needs of those paying their last respects at the reef.

Although the structure of the invention is not designed to prevent storm erosion, however, the habitat 10 can be structured to provide an altered current pattern thereby creating a protective wake on the reef's leeward side and preventing an area where fish can escape from strong currents.

The habitat 10 also eliminates the problem of limited space in a family plot, creating unlimited expansion using interior partitions consisting of movable or removable partitions for additional family members or larger marine life. In addition, the structure of habitat 10 is conducive to support video studios on migratory habitats and other scientific research.

The structure of habitat 10 comprises base anchors, masonry feet 24 and the variable lengths allow the base sections 30 to be above ground surface (benthic reef) as well as along ground surface (minimum profile reef) whereby modular design allows structural design adjustments as under water terrain changes require leveling adjustments where sand conditions vary.

The structure of habitat generates a venturi effect within a module 31, 32, generate far less resistance to storm damage than the venturi effect designed into the modular structure around the exterior. In addition, the exterior venturi effect creates superior oxygen and current flow to support marine life, taking highly oxygenated water to the bottom and thereby preventing anoxic stratification, thereby reducing the possibility of low dissolved oxygen levels.

While the invention has been explained with respect to a preferred embodiment thereof, it is contemplated that various changes may be made in the invention without departing from the spirit and scope thereof.

What is claimed is:

1. A portable, modular, underwater burial/marine habitat anchored on an underwater surface, said habitat consisting of:

masonry footers set on said underwater surface, a base section forming an extruded, concrete slab having two ends, two sides, a plurality of egress openings therein, a plurality of removable walls, and having a plurality of pre-positioned plugs inserted therein, each of said ends having a notch formed therein and said base section being fastened atop said plurality of masonry footers, a top section forming an extruded, concrete slab having two ends, two sides, and a plurality of egress openings formed therein, each of said ends having a notch formed therein, said top section being fastened atop said base section thereby forming a habitat module, and a flat covering fastened over each of said egress openings, each of said coverings having engravings identifying any objects placed therein.

2. The portable, modular, underwater burial/marine habitat of claim 1 wherein said base section and said top section are formed with slots for marine access.

3. A portable, modular, underwater burial/marine habitat anchored on the underwater surface, said habitat consisting of:

a plurality of masonry footers set on said underwater surface, a plurality of base sections being fastened on said plurality of footers, each of said base sections having two ends, a plurality of egress openings and movable walls, and each of said ends having a notch formed therein, a flat covering fastened over each of said egress openings, said plurality of base sections being assembled end to end and joined together with a locking device placed in adjoining notches, and a plurality of second tier modules being fastened atop said plurality of base sections, each of said second tier modules having two ends, a plurality of egress openings and movable walls, each of said ends having a notch formed therein, each of said second tier modules assembled end to end and joined together with a locking device placed in adjoining notches and a flat covering fastened over each of said egress openings.

* * * * *